United States Patent [19]

Wedzik

[11] 3,977,562

[45] Aug. 31, 1976

[54] PLASTIC LID WITH PULL

[76] Inventor: Theresa Marie Wedzik, 210 Hillcrest Ave., Erie, Pa. 16509

[22] Filed: July 22, 1975

[21] Appl. No.: 598,029

[52] U.S. Cl. ..... 220/270; 220/260; 220/266; 220/359; 229/7 R; 229/51 AS

[51] Int. Cl.[2] ..... B65D 41/32

[58] Field of Search ..... 229/7 R, 43, 51 AS, 229/260; 220/359, 257, 265, 258, 266, 270; 222/541

[56] References Cited

UNITED STATES PATENTS 3,302,858 2/1967 Miller ..... 229/7 R 3,711,011 1/1973 Kugher ..... 229/7 R

*Primary Examiner*—George T. Hall

[57] ABSTRACT

A lid for a cup is disclosed. The lid has a wedge shaped piece, that may be referred to as pie shaped with its point adjacent the center of the cup and extending out past the outer rim. A sheet of material, slightly larger than the wedge shaped piece, having an adhesive coated backing is attached to the wedge shaped cut out piece and holds the wedge shaped piece in its proper place on the lid. The adhesive sheet has an end tab which may be grasped by the operator to pull the adhesive coated sheet from the lid and with it, the wedge shaped cut out.

4 Claims, 10 Drawing Figures

PLASTIC LID WITH PULL

REFERENCE TO PRIOR ART

The invention disclosed constitutes an improvement over U.S. Pat. Nos. 2,740,547; 3,251,515; 3,281,024; 3,338,462; 3,339,788; 3,401,821.

OBJECTS OF THE INVENTION

It is an object of the invention to provide an improved container lid or a drinking cup lid.

Another object of the invention is to provide a drinking cup lid that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF DRAWINGS

DETAILED DESCRIPTION OF DRAWINGS

Figure 1:
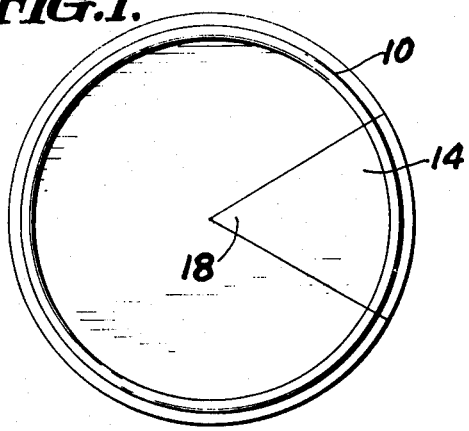
FIG. 1 is a top view of the lid according to the invention.
Figure 2:
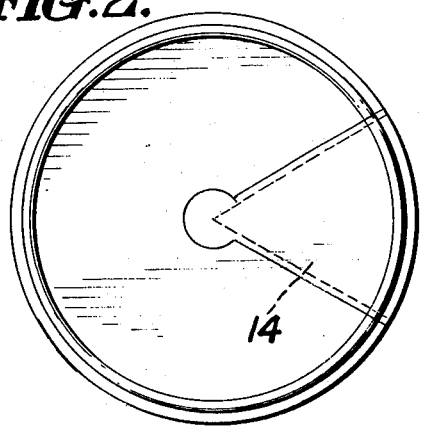
FIG. 2 is a top view of the lid, showing the adhesive coated tab applied to the lid.
Figure 3:
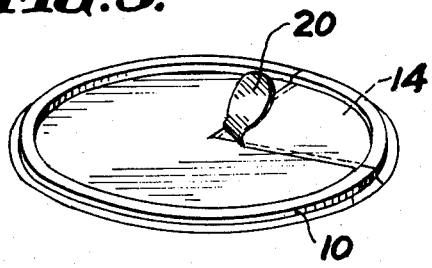
FIG. 3 is a view showing the hand engaging end of the tab raised and partly removed from the lid, bringing the point of the pie shaped cut out section of the lid with it.
Figure 6:
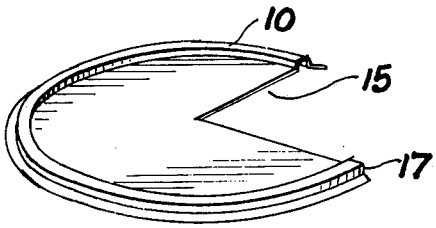
FIG. 6 shows the lid according to the invention with the pie shaped wedge removed.
Figure 8:
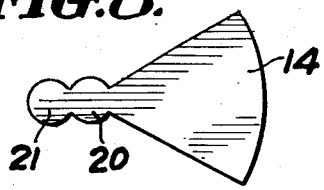
FIG. 8 shows the adhesive backed tab separate from the cup, as when first cut.
Figure 9:
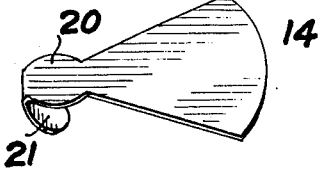
FIG. 9 shows the tab with the finger engaging sides prior to pressing together.
Figure 10:
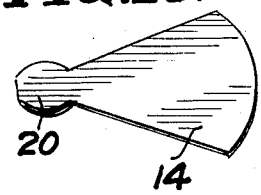
FIG. 10 shows the adhesive backed tab with the end section folded back and the adhesive coated sides pressed together.
Figure 4:
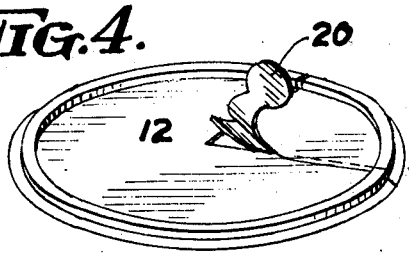
FIG. 4 is a view similar to FIG. 3 showing the wedge shaped cut out and tab further removed from the lid.
Figure 7:
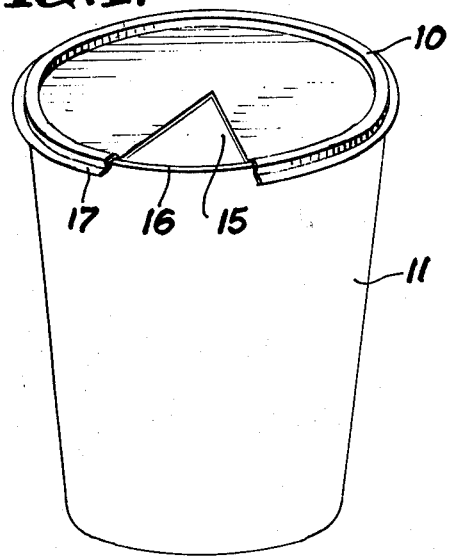
FIG. 7 shows a lid in place on a cup with the pie shaped wedge removed, ready for drinking.
Figure 5:
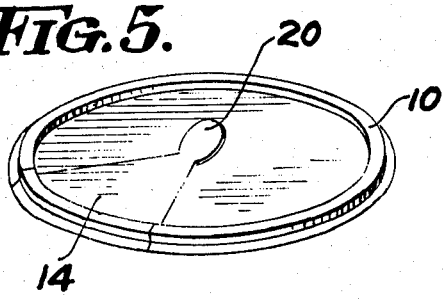
FIG. 5 is a view similar to FIG. 6 showing the tab slightly raised.

Now with more particular reference to the drawings, the lid indicated generally at 10 may be of the type generally used for soft drinks or liquid foods. It has the pie shaped or wedge shaped cut out 12 cut along lines 15 and normally supported in its original position by the pressure sensitive adhesive coated tab 14.

The cup may be any suitable form and made of a suitable material such as for example, plastic or paper and the lid may likewise be of a type and material familiar to those skilled in the art. The cup may have a rolled edge 16 over which the flange 17 on the lid 10 may extend.

The lid 10 may be made of plastic or paper or any suitable material and have the edges of the pie shaped, cut out wedge 12 severed completely.

The point 18 of the pie shaped, cut out 12 terminates adjacent the center of the lid 10 and the cut edges of the pie shaped cut out wedge diverge outwardly toward the rim. The pie shaped cut out may be completely severed from the lid or the cut can terminate just short of the tip so that the uncut edges will readily tear, yet they will prevent leakage and hold the pie shaped piece in place.

A high sensitivity adhesive is used so as to adhere to any exsisting plastic lids on the market and, when pulled with the right hand while the cup is held with the left hand, the cup will not be jarred and the tab will pull loose freely and easily, not spilling the contents of the cup.

The tab 14 may be a relatively thin sheet of material with a pressure sensitive adhesive material on one side and is slightly larger than the pie shaped piece 12. The tab 14 has diverging edges generally parallel to the edges of the pie shaped piece. The tab 14 overlies the pie shaped cut out 12 and terminates at the inner end in the hand engaging portion 20.

The hand engaging portion 20 of the tab 14 may have an extension 21 integrally attached when cut. As an option, the hand engaging portion could be plain backed (without adhesive) or coated with adhesive, and the coated sides of both extension 21 and the hand engaging portion 20 folded under the two parts pressed together, the double thickness portion will result with the adhesive coated sides facing toward each other so that the tab will not adhere to the fingers of the user. The way the tab will be made may be determined by the economics of the matter.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege are claimed are defined as follows:

1. A lid for a cup or the like having a pie shaped wedge cut out piece terminating at a point adjacent the center of said lid and having two relatively straight diverging cut sides intersecting at said point, a tab made of a relatively thin sheet of material coated on one side with pressure sensitive adhesive, said tab being slightly larger than said pie shaped wedge cut out piece, the edges of said tab overlying said cut edge and extending beyond said cut edges of said pie shaped wedge cut out piece and adhered to said pie shaped piece and to said lid holding said pie shaped piece in place, an end of said tab extending beyond the point of said wedge shaped piece and defining a finger engaging piece integrally attached to said tab, said finger engaging piece being adapted to be grasped by an operator and pulled from said lid whereby said point of said pie shaped wedge cut out piece is lifted first and may be readily removed.

2. The lid recited in claim 1 wherein said finger engaging piece is formed by an extension on said tab which is folded back on itself with the adhesive surfaces of said extension engaging the adhesive surface of said finger engaging piece.

3. The lid recited in claim 2 wherein said pie shaped wedge cut out piece is uncut adjacent the rim of said lid whereby said piece is further held in place by said uncut portion of said rim holding said pie shaped wedge cut out piece in place.

4. The lid recited in claim 1 wherein said cap is supported on a cup having a rolled rim, said lid has a channel generally U-shaped in cross section receiving said rim, said pie shaped wedge cut out piece has cut edges extending through said channel to the outer edge of said cap.

* * * * *